United States Patent [19]

Lam

[11] Patent Number: 4,708,414

[45] Date of Patent: Nov. 24, 1987

[54] ELECTRIC WIRE CONNECTOR FOR COAXIAL CABLE

[76] Inventor: Albert Lam, 16Fl., BK40, 550 Victoria Road, Hong Kong, Hong Kong

[21] Appl. No.: 8,829

[22] Filed: Jan. 30, 1987

[51] Int. Cl.[4] ..... H01R 4/24

[52] U.S. Cl. ..... 439/394; 439/427; 439/582

[58] Field of Search ..... 339/97 R, 97 P, 98, 339/99 R, 100, 177

[56] References Cited

U.S. PATENT DOCUMENTS 3,950,063 4/1976 Johansson ..... 339/97 R 4,261,632 4/1981 Narozny ..... 339/97 R 4,379,605 4/1983 Hoffman ..... 339/97 P

*Primary Examiner*—Joseph H. McGlynn

*Attorney, Agent, or Firm*—Roylance, Abrams, Berdo & Goodman

[57] ABSTRACT

A wire connector for a coaxial cable includes a housing constituted of a base and a cover hinged together for receiving an end of a cable, and a serrated penetrating member to penetrate through the outer insulating layer of the cable to contact the outer conductor when the cover is depressed against the base. The serrated penetrating member has an end contacting a contact portion of a conductive sleeve member which surrounds a pin plug member having a contact end to contact the inner conductor of the cable. The cable is connected to the connector by pressing the cover against the base.

8 Claims, 5 Drawing Figures

ELECTRIC WIRE CONNECTOR FOR COAXIAL CABLE

BACKGROUND OF THE INVENTION

This invention relates to an electrical wire connector used for connecting coaxial cables, and particularly to one having a housing to receive an end of the cable, a serrated penetrating member which penetrates through the insulating layer of the cable to contact an outer conductor of the cable and which is connected electrically to a sleeve member, and a pin plug member having a contact end to contact an inner conductor of the cable.

A typical conventional coaxial cable connector includes a substantially cylindrical casing for receiving the end of a coaxial cable. The outer insulating layer of the coaxial cable must be peeled away from the outer conductor and the outer conductor must be folded outward to contact with the inner wall of the casing when the cable is inserted into the casing. The inner conductor of the cable thereby exposed enters a forwarding tube-like plug portion integrated with the cylindrical casing. It is somewhat inconvenient to use such a wire connector since the insulating layer of the cable has to peeled off from the conductor.

SUMMARY OF THE INVENTION

An object of the present invention is to provide an improved electric wire connector used for coaxial cable which is of simple construction and convenient to use.

The present invention provides an electric wire connector which comprises: a base member having a trough thereon for receiving the coaxial cable, and a first engaging member; a conductive sleeve secured to the base plate member and having a contact portion extending near the trough; a conductive pin plug disposed in the sleeve, secured to the base plate member and having a contact portion extending near the trough for contacting the inner conductor of coaxial cable; a press cover for covering the base member having one edge hinged to the base member, an access to the trough, and a second engaging member to engage with the first engaging member when the press cover is pressed against the base member and a serrated penetrating member attached to the inner side of the press cover, and having a serrated edge to penetrate into the coaxial cable so as to contact the outer conductor of the coaxial cable, and a contact end abutting with the contact portion of the sleeve member.

The first engaging means of the base member may include engaging slots provided in the base member, and the second engaging means of the press cover may include engaging pins to engage in the engaging slots respectively.

The serrated penetrating member may be a plate member shaped to have a U-shaped transverse cross-section, two spaced opposing serrated portions and a longitudinal resilient curved end which bears against the contact portion of the sleeve plug member.

The present preferred embodiment will be described in detail with reference to the accompanying drawings, in which:

DETAILED DESCRIPTION OF THE PREFERRED EMBODIMENT

Figure 1:
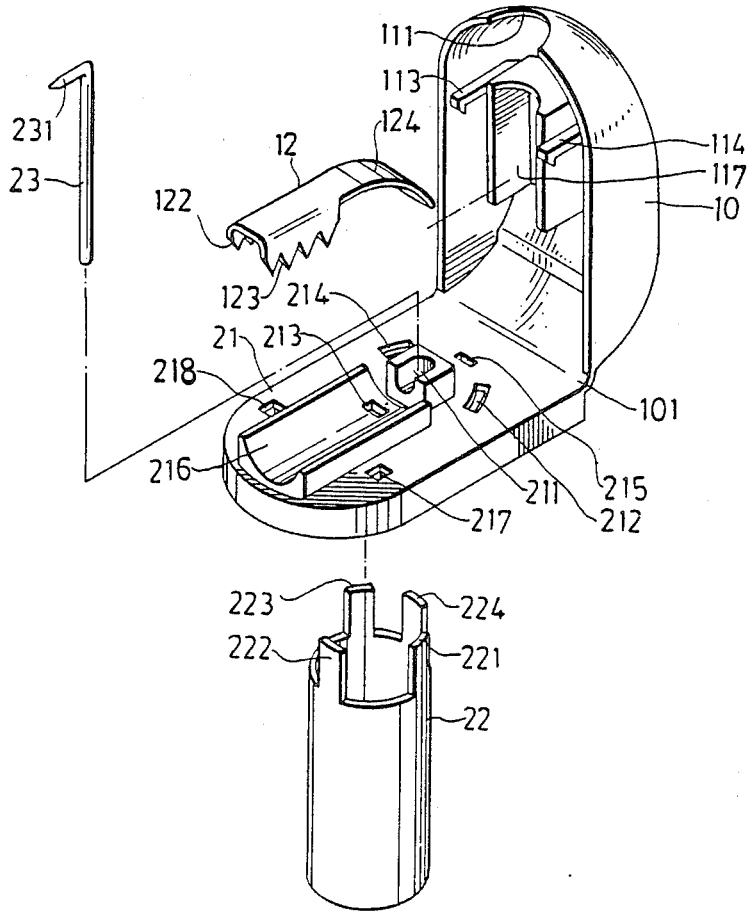
FIG. 1 is an exploded view of a wire connector according to the present invention.
Figure 5:
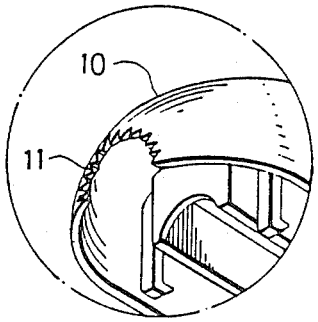
FIG. 5 is a fragmentary view showing a serrated notched edge of the press cover.
Figure 2:
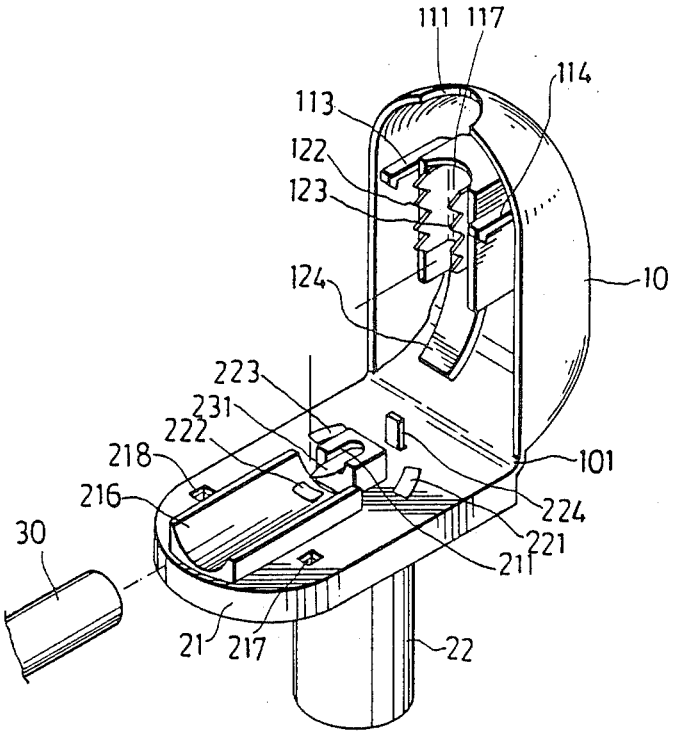
FIG. 2 is a perspective view of the wire connector of FIG. 1 in which the press cover is open.
Figure 4:
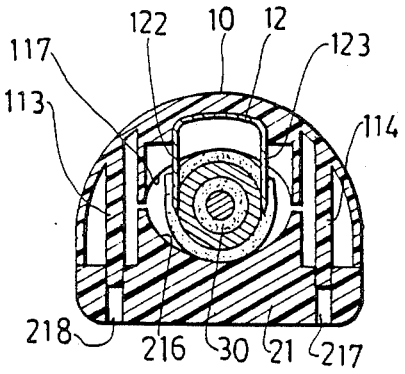
FIG. 4 is a sectional view taken along line 4—4 of FIG. 3.
Figure 3:
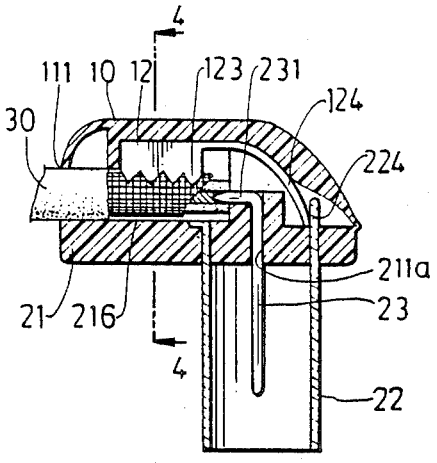
FIG. 3 is a sectional view of the wire connector of FIG. 1.

Referring to the drawings, there is shown an embodiment of the electric connector according to the present invention, having a base member 21 and a press cover 10 connected hingedly together for cooperatively receiving a coaxial cable 30 and a conductive sleeve member 22 and a pin plug 23 connected to the base member 21 and used for connecting electrically the coaxial cable 30 to a socket means of an electric apparatus.

The base member 21 is substantially a plate-shaped plastic molded body and is formed integrally with the plastic press cover 10 which is hinged thereto by means of a flexible member 101 which is one piece with the base member 21 and the press cover 10. While the base member 21 and the press cover 10 are one piece as shown, they can be formed separately and then hinged together by a way as is known by any one skilled in the art. A trough 216 and a pin plug seat 211 are formed integrally on the base member 21. The press cover 10 is a bowl-like member and has a notch 111 at an edge thereof opposite to the hinged side 101 to serve as an access to the trough 216. Preferably, the notch 111 may be serrated so as to provide firm engagement with the cable 30. Two engaging pins 113 and 114 project downward from the inner side of the wall of the press cover 10 to be press-fitted in two engaging slots 217 and 218 of the base member 21 when the cover is pressed against the base member 21. A metallic serrated penetrating member 12 of U-shaped cross-section is received and fixed in a seat 117 protruded from the inner side of the press cover 10, having two spaced parallel serrated portions 122 and 123 and a longitudinal resilient curved end 124. The spaced parallel serrated portions 122 and 123 lie in planes substantially parallel to the plane of the axis of the cable 30, and the distance between them is arranged to be slightly smaller than the diameter of the coaxial cable used so that the serrated portions 122 and 123 penetrate the outer insulating layer and contact the outer conductor without affecting the inner insulating layer and the inner conductor. The resilient curved end 124 normally urges the press cover 10 to move away from the base member 21.

The conductive sleeve 22 has four projections 221, 222, 223 and 224 axially extending from the end of the sleeve plug 22, the projectios 221, 222, 223 and 224 being inserted in slots 212, 213, 214 and 215 respectively. The end of the projections 221, 222 and 223 are bent and pressed against the base member 21, thereby securing the sleeve 22 to the base member 21. The end of the projection 224 serves as a contact portion to contact the curved end 124 of the penetrating member 12. The pin plug 23 is placed in the sleeve 22 and inserted immovably in a slot 211a of the pin plug seat 211. It has a right-angled portion 231 lying axially relative to the axis of the inner conductor and having a pointed end to contact the inner conductor of the cable 30.

In order to connect the coaxial cable 30 to the wire connector of the invention, the end of the cable is first inserted into the interior of the base member 21 and the press cover 10, placed in trough 216, and pushed against the contact portion 231 of the pin plug 23 to cause the inner conductor of the cable to contact the contact portion 231 of pin plug 23. Then, the press cover 10 is pressed against the base member 21 to cause the engaging pins 113 and 114 to be engaged with the engaging slots 217 and 218. As the press cover 10 is depressed, the serrated portions 122 and 123 of the penetrating member 12 penetrate the insulating layer of the cable and contact with the outer conductor of the cable, and the resilient curved end 124 of the penetrating member 12 contacts tightly against the projection 224 of the sleeve member 22, thereby electricallly connecting the outer conductor of the cable and the sleeve member 22. It is very convenient to connect a cable to the wire connector of the present invention since the insulating layer of the cable need not be removed from the conductors and the connection can be accomplished just be pressing the press cover 10 against the base member 21.

With the invention thus explained, it is apparent that various modifications and variations can be made without departing from the scope of the invention. It is therefore intended that the invention be limited as indicated in the appended claims.

What I claim is:

1. An electric wire connector used for a coaxial cable having an inner conductor and and an outer conductor;

a base member having a trough thereon for receiving the coaxial cable, and a first engaging means;

a conductive sleeve secured to said base member and having a contact portion extending near said trough;

a conductive pin plug disposed in said sleeve, secured to said base member and having a contact portion extending near said trough for contacting the inner conductor of the coaxial cable;

a press cover for covering said base member having one side hinged to said base member, an access to said trough, and a second engaging means to engage with said first engaging member when said press cover is pressed against said base member; and a serrated penetrating member attached to the inner side of said press cover, and having a serrated edge to penetrate into the coaxial cable so as to contact the outer conductor of the coaxial cable, and a contact end abutting with said contact portion of said sleeve member.

2. An electric wire connector as claimed in claim 1, wherein said sleeve member has axial projections extending from one of its ends and secured in said base member, one of said axial projections defining said contact portion of said sleeve member.

3. An electric wire connector as claimed in claim 1, wherein said first engaging means of said base member includes engaging slots provided in said base member.

4. An electric wire connector as claimed in claim 1, wherein said second engaging means of said press cover includes engaging pins to engage in said engaging slots respectively.

5. An electric wire connector as claimed in claim 1, wherein said base member further includes a pin plug positioning seat near said trough.

6. An electric wire connector as claimed in claim 5, where said pin plug member is a pin member inserted through said base member and said pin plug positioning seat and then angled 90 degrees to lie axially relative to the inner conductor of said coaxial cable and pointed at its end to define said contact portion of said pin plug member.

7. An electric wire connector as claimed in claim 1, wherein said serrated penetrating member is a plate member shaped to have a U-shaped transverse cross-section, two spaced parallel serrated portions and a longitudinal resilient curved end which bears against said contact portion of said sleeve member, the spaced parallel serrated portions being arranged in planes substantially parallel to the plane of the axis of the cable.

8. An electric wire connector as claimed in claim 7, wherein the distance between said parallel serrated portions are slightly smaller than the diameter of the cable.

* * * * *